US006540830B1

(12) United States Patent
Russell, Jr. et al.

(10) Patent No.: US 6,540,830 B1
(45) Date of Patent: Apr. 1, 2003

(54) APPARATUS FOR COATING THE ENDS OF FUSER ROLLS

(75) Inventors: James G. Russell, Jr., Fairport, NY (US); Sandra L. Schmitt, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 220 days.

(21) Appl. No.: 09/655,078

(22) Filed: Sep. 5, 2000

(51) Int. Cl.[7] ..... B05C 1/06

(52) U.S. Cl. ..... 118/206; 118/218; 118/219; 118/221; 118/222

(58) Field of Search ..... 118/100, 107, 118/120, 200, 206, 218, 219, 221, 222, 232, 241, 304, 320, 321, 323; 427/356, 425, 358

(56) References Cited

U.S. PATENT DOCUMENTS

| | | | | | |
|---|---|---|---|---|---|
| 4,035,212 | A | * | 7/1977 | McRitchie | 156/187 |
| 5,702,765 | A | * | 12/1997 | Damrau et al. | 427/356 |
| 5,871,818 | A | * | 2/1999 | Button et al. | 427/356 |
| 5,871,832 | A | | 2/1999 | Finn et al. | 428/98 |
| 6,335,055 | B1 | * | 1/2002 | Miyahara et al. | 427/356 |

* cited by examiner

*Primary Examiner*—Richard Crispino
*Assistant Examiner*—George R. Koch, III
(74) *Attorney, Agent, or Firm*—Perman & Green, LLP

(57) ABSTRACT

A method and apparatus is provided to apply a polymeric coating to the ends of a fuser roll. A wiper arm is constructed having a wiper edge with may be rotated into contact with the end to be coated. Coating solution is applied to the wiper edge and allowed to flow onto the end surface of the roll.

6 Claims, 4 Drawing Sheets

FIG. 2A
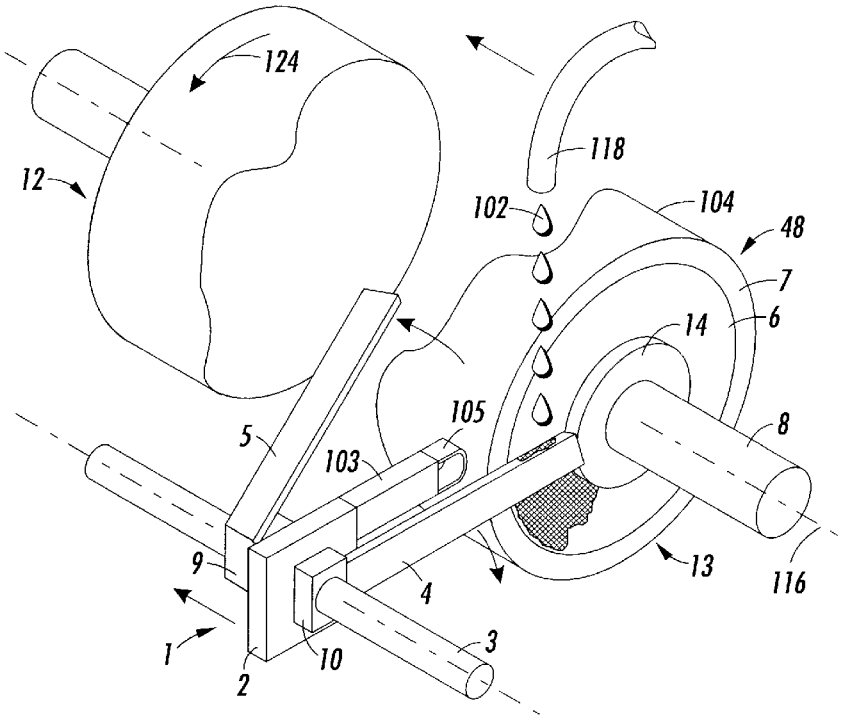
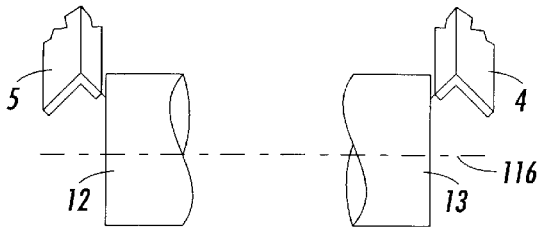
FIG. 2B
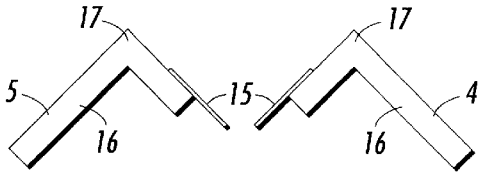
FIG. 2C

APPARATUS FOR COATING THE ENDS OF FUSER ROLLS

BACKGROUND OF THE INVENTION

The present invention relates to a method and apparatus for a printing system. More specifically, the invention relates to the manufacture of printer rolls and belts for printing systems. The features of the present invention are useful in the printing arts and more particularly in electrophotographic printing.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto by fusing the toner image to the paper to form a permanent record of the image to be reproduced.

Several components in the electrophotographic printing process described above are in the form of polymeric rolls and belts. Fusing rolls, which are used to fix the toner image on a substrate, represent a component that is typically in the form of polymeric rolls or belts. Also included among these components are bias charge rolls (BCRS) and bias transfer rolls (BTRS) which electrostatically charge the photoreceptor. In addition such rolls and belts include the pressure or backup roll used with a fusing roll to fix the toner image on a substrate, donor rolls which transfer oil to the fuser roll that assists in releasing the toner from the fuser roll, intermediate transfer rolls and belts that transfer developed images, photoconductive belts and rolls, and those belts and rolls used in Hybrid Scavangeless Development (HSD). All of these a polymeric rolls and belts are typically manufactured by spraying or by dipping of the above mentioned components.

It is particularly difficult to manufacture fuser rolls and belts because of the elevated temperatures and pressures to which these rolls are subjected and the accurate size and finish requirements necessary to insure proper copy quality.

The fusing of the toner image to the paper to form a permanent record of the image is an important part of the xerographic process. Fusing of the toner image is typically done by heat fixation. The heat fixation may be in the form of radiation, conduction, convection or induction. Most modern xerographic processes utilize conduction heating of the toner image to adhere the image to the paper. To accomplish this purpose a fusing roll is placed in rolling contact with a backup roll forming a nip. The paper having the transferred toner image is fed between the rolls through the nip. Heat from the fusing roll together with the pressure within the nip, between the fuser roll and the backup roll, serve to fuse the image to the paper. Heat is typically applied internally within the roll and is transferred through the substrate of the roll onto the periphery of the roll and onto the paper.

The rolls typically include a thermally conductive substrate with a surface layer which is also thermally conductive. To assure uniform transfer of the image onto the paper, typically the fuser roll coating is conformable to the paper. For example, the coating may be in the form of a rubber or polymer material, e.g. a fluoroelastomer coating. Applying fluorelastomer and other rubber type coatings to fuser roll substrates are fraught with many problems. The coating may be applied to the substrate by two typical methods which are dipping of the substrate into a bath of coating solution or spraying the surface of the substrate with the coating material.

Spraying is the typical method for the manufacture of fluoroelastomer rollers and it is slow and costly. Also, the spraying process requires having the coating solution in a form that is volatile including many volatile organic chemicals. Further, the spraying process is prone to air pockets or pits forming in the coating. These pits or air pockets in the coating material of the roll result in improper fusing and poor image quality. Because of the nature of the spray process, much of the coating material is lost in the atmosphere requiring an excess amount of the expensive coating material utilized. Also, the loss of the volatile chemicals result in expensive containment costs for systems to contain the volatile chemicals as well as disposal costs of these materials.

This invention is intended to alleviate at least some of the above-mentioned problems for at least some of the several components in the electrophotographic printing process described above which are in the form of polymeric rolls and belts.

A more recent process attempts to apply coating solution by dripping material over a horizontally rotating cylinder. With this process a portion of the material adheres to the cylinder and the remainder drips from the cylinder. The amount of material added to the roll is not precisely controlled as the percentage that adheres varies as parameters change over the production run. Also the material forms a wavy coating surface where the material is poured. This so called flow coating method may be enhanced by means of a flexible wiper applied to the surface of the roll as the coating is applied, as described in U.S. Pat. No. 5,871,832 the disclosure ot which is incorporated herein by reference. This tends to provide a more even coating thickness.

During the processing in accordance with the prior art there is little attention paid to the end surfaces of the rolls. It is generally desirable to coat the ends of the roll to close the edges of the coating and seal the metal end plates. It is a purpose of this invention to provide an apparatus and method for coating the ends of a fuser roll in conjunction with the coating of the cylindrical surface of such rolls.

SUMMARY OF THE INVENTION

A flow coating process is adapted to apply a coating to the end surfaces of a cylindrical fuser roll. To accomplish this purpose a coating station is designed for insertion within the coating operation of a fuser production line. The coating station comprises a nozzle mounted in the path of the production line for applying a flouroelastomer (polymeric) coating solution to a cylindrical fuser roll. The fuser roll is secured on a transport for movement through the coating station in a direction transverse to the axis of the roll. The fuser roll is mounted on the transport for rotary movement about its longitudinal axis. The process control stops the fuser roll in the station and rotates the roll under the nozzle while the nozzle translates over the roll in a motion which is parallel to the axis of the roll. To coat the ends of the roll, the nozzle is held stationery at the ends of the roll, while the roll is rotated.

A pair of arms are mounted on a transfer head in the station for movement parallel to and coordinated with the nozzle. Each of the arms are constructed to independently rotate towards and away from the fuser roll between a retracted position and an operational position. Rotation of the arms is controlled so that only one nozzle is operational at a given time. In the operational position, the arm assembly is located at the end of the fuser roll and one of the arms extends generally horizontal under the nozzle.

When the nozzle begins its application cycle, it will generally be positioned above one end of the fuser roll. According to this invention, the arm assembly is positioned at the same axial location as the nozzle either just ahead or just behind the roll. In the operative position the stream of solution from the nozzle will flow vertically downward immediately adjacent to the end of the roll. The operative arm is rotated under the stream to cause a deflection of the stream towards the end of the roll.

Each of the arms are formed having a near edge and a far edge relative to the end of the fuser roll. The near edge is constructed having a surface which is shaped to deflect the coating stream towards the end surface of the roller. The far edge is shaped to direct excess coating solution away from the roller to avoid splattering the cylindrical surface and marring the finish coating of the cylinder.

DESCRIPTION OF THE DRAWING

The invention is described in more detail below with reference to the attached drawing in which:

FIG. 2*a* is a schematic illustration of the end coating apparatus of this invention;

FIG. 2*b* is an illustration showing the engagement of the wiper arms with the ends of the roll;

FIG. 2*c* is an end view showing the profile of the wiper arms;

DETAILED DESCRIPTION OF THE INVENTION

Figure 1:
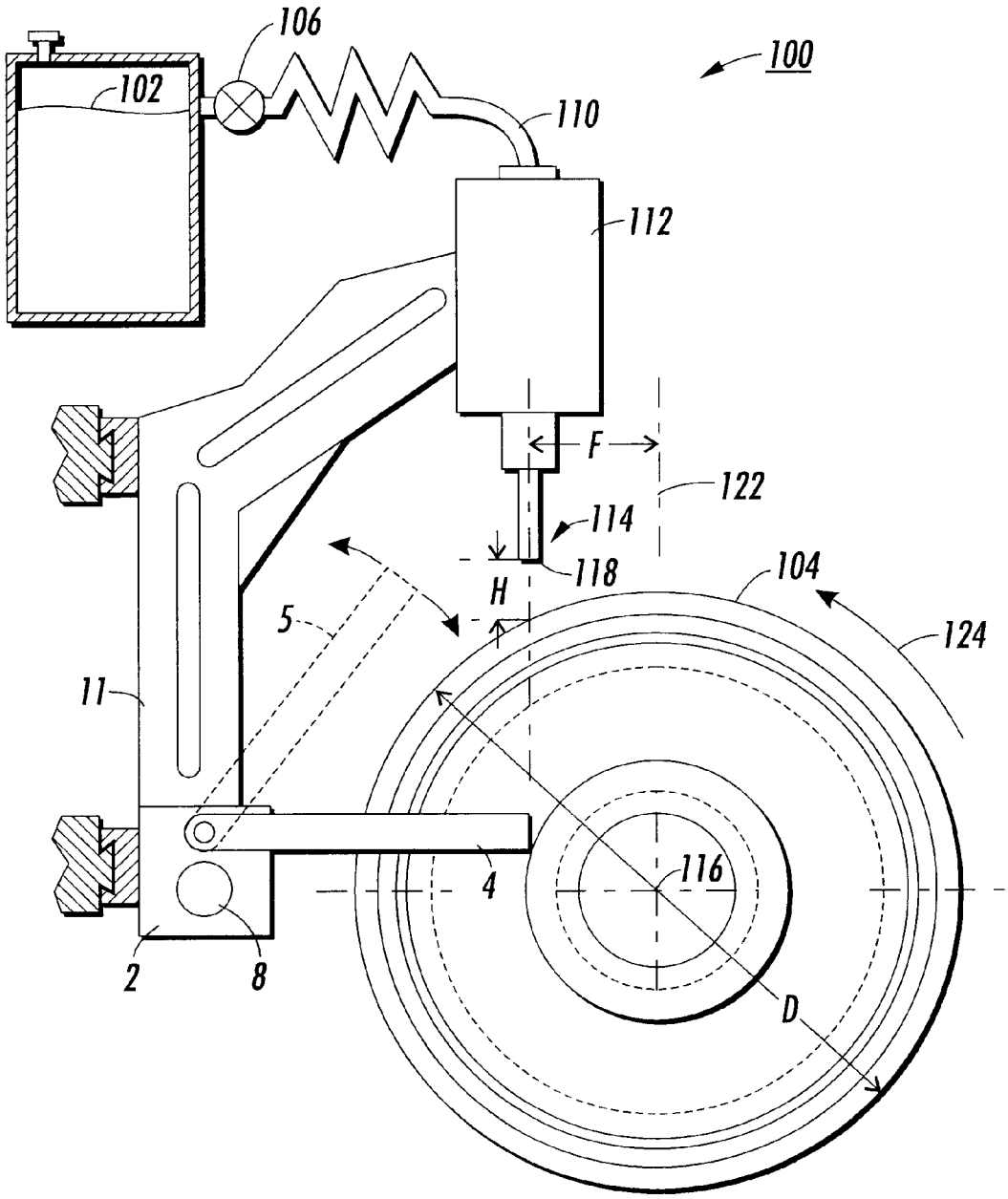
FIG. 1 is a schematic illustration of the roll coating apparatus of this invention.
Figure 3:
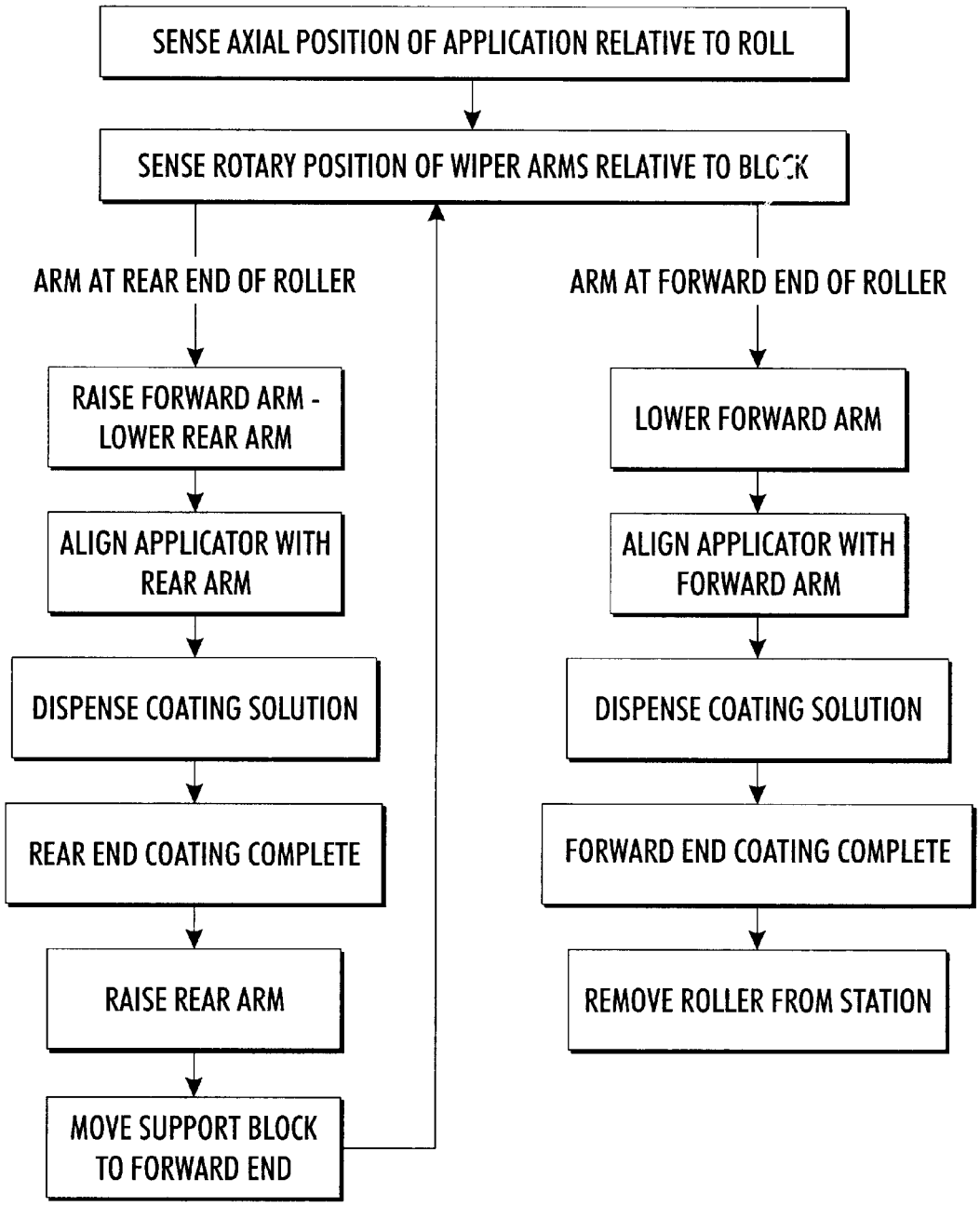
FIG. 3 is a chart of the process of this invention.

Referring now to FIG. 1, apparatus 100 is shown for coating polymeric printing rolls or belts for example: xerographic fuser roll 48. It should be appreciated that the apparatus 100 may be utilized for flow coating any of a number of polymeric printing rolls or belts including but not limited to bias charge rolls (BCRs), bias transfer rolls (BTRs), pressure rolls, backup rolls, fuser donor rolls, intermediate transfer rolls and belts, photoconductive belts and rolls, development rolls and belts and development donor rolls and belts, and Hybrid Scavangeless Development rolls and belts.

The apparatus 100 may be used to apply coating solution 102 to surface 104 of the fuser roll 48. The coating solution is pumped via pump 106 through a conduit typically in the form of a pipe 110 to an applicator 112 including nozzle 114 through which the coating solution 102 flows onto cylindrical surface 104 of the roll 48.

The coating solution 102 is applied to the surface 104 in a spiral fashion by rotating fuser roll 48 about its longitudinal axis 116, while the applicator 112 translates in a direction parallel to the longitudinal axis 116. This process is referred to as flow coating.

The apparatus 100 may have any suitable form and may consist of any equipment capable of rotating the fuser roll 48 about longitudinal axis 116 while translating the applicator 112 in a direction parallel to the longitudinal axis 116. Specialty equipment may be designed which will rotate the fuser roll while translating the applicator within a controlled space, thereby permiting the proper enclosure of the apparatus 100 to contain the volatile coating solution and to maintain the environmental conditions necessary for quality coatings from this process.

According to the present invention, applicants have found that the placement of a member in the form of a loop type guide or wiper 103 against the surface 104 of the roll 48 as the coating solution 102 is applied to the roll, significantly improves the uniformity of the coating as it is applied to the surface 104 of roll 48. In some instances, the longitudinal axis 116 of the roll 48 is positioned horizontally with respect to the floor of the building in which the apparatus is housed to allow the affects of gravity to properly distribute the coating solution 102 about the surface 104.

In FIG. 2*a,* wiper 103 is shown extending towards roll 48 from the support block 2 and will engage surface 104 during the coating operation. The tip 105 of the wiper 103 is formed as a loop of thin flexible material which deforms slightly to conform to the contour of the roll 48. During the coating of the cylindrical portion 104 of the roll 48, the coating solution 102 is applied in alignment with the wiper 103.

The applicator 112 is preferably positioned above the fuser roll 48 so that the stream of coating solution coming from the nozzle 114 may flow over the surface 104 of the roll 48. Tip 118 of nozzle 114 is preferably spaced a distance H above the surface 104 of the roll 48. If the tip 118 is placed too far from the surface 104 the coating solution 102 congeal before it reaches the surface 104. If the tip 118 is placed too closely to the surface 104, it will touch with an undesirable effect. For a roll having a diameter D of approximately four inches, the applicants have found that a distance H of approximately ¼ of an inch is adequate. Applicants have also found that it is acceptable to position the applicator 112 at a position F of approximately one inch from vertical axis 122 of the roll in the direction of rotation 124 of the roll. The dynamics of the rotation of the roll and its position on the surface of the roll assist in the uniform distribution of the solution 102 on the roll.

In accordance with this invention, the flow coating process described above is further adapted to apply the polymeric coating to the ends of a fuser roll. As stated above the process and apparatus of this invention is not limited to fuser rolls, but includes the manufacturing of all similar rolls. As shown in FIGS. 1 and 2, an end coating module 1 is mounted on a transfer frame 11 through a support block 2. Support block 2 is mounted for movement along guide rail 3 in a direction parallel to the roll 48.

A pair of arms 4 and 5 are mounted on drive blocks 9 and 10 for rotary movement about the guide rail 3 towards and away from the roller 48. Support block 2 is shown in FIG. 1 to be part of the transfer frame 11. Accordingly the end coating module 1 will move axially as a unit with the coating solution applicator 112. These components of the system need not necessarily be one unit as long as their axial movement relative to the roll 48 is coordinated.

For the purpose of this description, end roll 48 is depicted having a forward end 12 and a rear end 13. As shown in FIG.

2, each of the ends has a resilient edge 7, a metallic end plate 6, and a bearing journal 14. In general the type of rolls processed by this apparatus have a soft outer layer constructed of rubber or other similar resilient material, however a rigid substrate may also be coated by using this invention. The bearing journal 14 is constructed to receive a mounting shaft for final assembly. In the production line of this process, the roll 48 is mounted on its shaft for rotation in the clockwise direction, as shown by arrow 124. This rotary motion coupled with the translation of the applicator 112 will apply the coating to the cylindrical surface 104 of the roll 48 with a pitch.

The end coating module 1 allows the flow coating method to be used for applying polymeric coating to the end plates 6 and edge 7 of the roller 48 to seal the edge and protect the underlying substrate. To accomplish this the applicator must be controlled to direct the flow of coating solution to the edge of the wiper arms 4 and 5. Coordination of the position of the support block 2 and the applicator 112 is needed. The applicator is mounted on the transfer frame for movement relative to the support block 2 between multiple positions, one at which the coating solution is applied to the edge of the forward arm 5 and the other position at which the solution 102 is applied to the rear arm 4. In the event that full coating of the surface 104 is also to be accomplished at the same station, the nozzle 118 must be aligned with the wiper 103. Although it may be advantageous in some circumstances to use only a single wiper arm, for example: arm 4, it is preferred to use a pair of arms for reasons that will be described later in this application.

The forward and rear wiper arms 4 and 5 are fixed to drive blocks 9 and 10. The drive blocks may be associated with any appropriate drive mechanism such as motor driven gears or belts to provide a suitably controllable rotary motion to arms 4 and 5. As illustrated in FIG. 1, the arms 4 and 5 may be mounted independently of the guide rail 3. The arms 4 and 5 rotate between two positions an operational position and a retracted position, as shown in FIGS. 1 and 2. Only one of the arms will be rotated to its operational position at the same time depending on whether the forward end 12 or rear end 13 is being coated. Both of the arms will be in the retracted position when the assembly is moved from one end to the other.

Arms 4 and 5 are shaped, as shown in FIGS. 2*b* and 2*c*, and are constructed generally with a flexible edge 15 fixed to a stub 17. Stub 17 extends at an angle to the body 16 of the arms 4 and 5 to facilitate the wiping action of the edge 15. The extended body portion 16 is designed to direct excess amounts of coating solution 102 away from the roll 48 to prevent splattering and resulting marring of the finish of the cylindrical surface of roll 48. The arms 4 and 5 are constructed with opposing profiles to properly engage and cooperate in the desired manner with the applicator 112.

Figure 5:
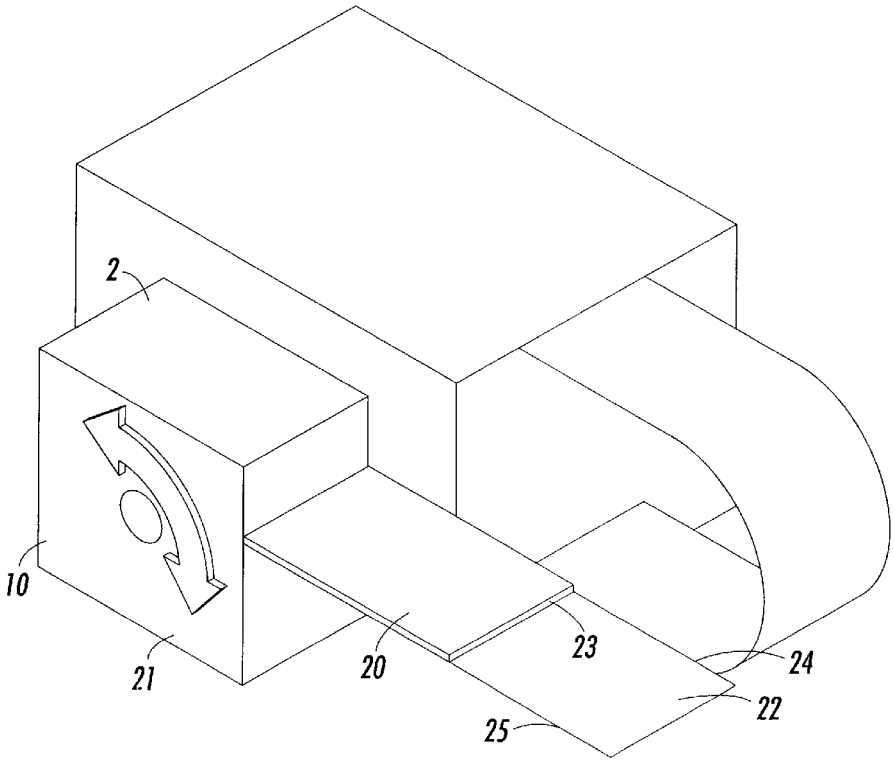
FIG. 5 is a schematic illustration of the wiper assembly according to another embodiment of the invention.

In the alternative, the shape of arms 4 and 5 could be constructed as shown in FIG. 5. In this embodiment a rigid arm 20 extends outward from the drive block 21 and a flexible end blade 22 is connected at the end 23 of arm 20. The wiping action is provided by forward edge 24 or rear edge 25, depending on which end of the roll is being processed. In the event that two end wiper arms are provided as described above then only one of the edges of the blade 22 will be operational.

Figure 4:
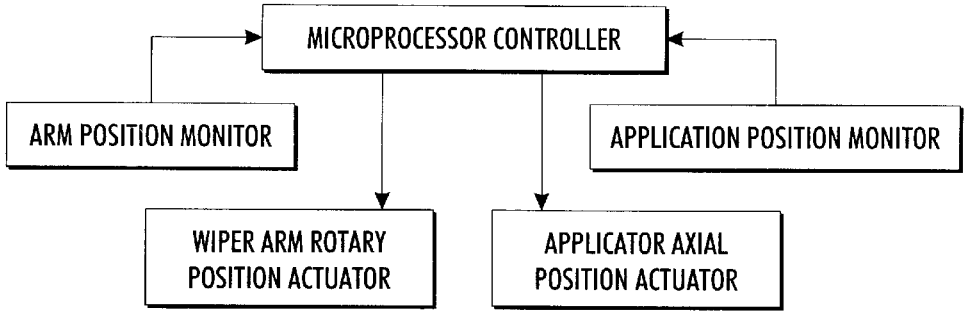
FIG. 4 is a block diagram of the control system for the apparatus of this invention.

In order to control the operation of the components of the system of this invention, a microprocessor 18 or other computer component is provided. Microprocessor 18 is connected to receive data from sensors 19 and 20. Sensor 19 monitors the position of the arms 4 and 5 on support block 2, while sensor 20 monitors the axial position of the applicator 112. Sensor data is processed by microprocessor 18 and signals are generated to appropriately align the components and adjust the arms to their appropriate positions. In the chart of FIG. 4, the process starts at the rear end 13 and when the components are sensed to be in this position, wiper arm 4 is rotated into position engaging edge 15 against the end 13 of the roll 48. The applicator is aligned with wiper arm 4 and coating solution 102 is dispensed. The solution 102 flows over edge 15 to coat the end surface 13 with excess being directed away by the body portion 16 of arm 4.

It should be noted that while the solution 102 is being applied to the end surface 13, the roll is rotating, but the wiper arm assembly is axially stationary. After a predetermined length of time has expired, the controller 18 will actuate movement of the applicator 112 to the forward end 12 for coating the other end of the roll. During such movement, the wiper arms 4 and 5 are rotated to their retracted position. In addition during this movement coating solution 102 may be applied to the cylindrical surface of roll 48. It may be preferable to coat this surface at a different station. To continue coating surface 104, Arm 4 is raised to avoid contact with the roll 48 and the applicator 112 is aligned with the wiper 103. Roll 48 turns as the coating components traverse the length of the roll 48. At the forward end 12, arm 5 is lowered and the applicator 112 is aligned with arm 5 to coat the far end 12.

In this manner the general method of flowing coating is used effectively apply polymeric coating to the sides a cylindrical roll. This invention may also be effective in coating rolls which have highly angular profiles or tapers.

We claim:

1. An applicator assembly for use in the application of a polymeric coating to the ends of a substrate, comprising:

an applicator mounted generally above the substrate to apply a stream of coating solution to said substrate, said substrate being mounted to rotate under said applicator about a first axis, and said applicator being moveable with respect to said substrate in a direction parallel to said first axis;

said applicator assembly further comprising a wiper assembly, said wiper assembly comprising:

a transfer block mounted for movement relative to the substrate in a direction parallel to said first axis of rotation of the substrate from a first end of said substrate to a second end of said substrate;

at least one wiper arm mounted on the transfer block for rotation about a second axis parallel to said first axis, said second axis being displaced from said first axis a predetermined distance, and said wiper arm having a length sufficient to bridge said predetermined distance and engage said first or second ends of said substrate;

a rotary drive operatively associated with said wiper arm to cause rotary movement of said wiper arm between a position of engagement with said first or second ends and a position displaced from said substrate;

a linear drive operatively associated with said transfer block to cause said transfer block to move parallel to said first axis in coordination with said applicator between said first and second ends of said substrate; and wherein said applicator applies coating solution to the wiper arm when said arm is rotated into engagement with said first or second end of said substrate and said coating solution is allowed to flow onto the end of the substrate as said substrate is rotated.

2. A wiper assembly for use in the application of a polymeric coating to the ends of a substrate, in which the substrate is positioned to receive a stream of coating solution from an applicator mounted generally above the substrate, said substrate being mounted to rotate under said applicator about a first axis, said wiper assembly, as described in claim 1, further comprising a controller operatively connected to said drives and the applicator to align said applicator with said wiper arm and apply coating solution to said wiper arm when said wiper arm is adjacent to said said first or second end of said substrate in said position of engagement.

3. A wiper assembly for use in the application of a polymeric coating to the ends of a substrate, in which the substrate is positioned to receive a stream of coating solution from an applicator mounted generally above the substrate, said substrate being mounted to rotate under said applicator about a first axis, said wiper assembly, as described in claim 2, wherein said at least one arm comprises a pair of arms mounted on said transfer block for rotary motion in parallel planes, wherein one of said arms is positioned to engage said first end of said substrate and the other of said arms is positioned to engage said second end of said substrate, and wherein the operation of said applicator is coordinated by said controller with one or the other of said pair of wiper arms depending on the location of the applicator and transfer block.

4. A wiper assembly for use in the application of a polymeric coating to the ends of a substrate, in which the substrate is positioned to receive a stream of coating solution from an applicator mounted generally above the substrate, said substrate being mounted to rotate under said applicator about a first axis, said wiper assembly, as described in claim 3, wherein said applicator is mounted for movement relative to said transfer block to allow said applicator to be aligned with either of said pair of wiper arms.

5. A wiper assembly for use in the application of a polymeric coating to the ends of a substrate, in which the substrate is positioned to receive a stream of coating solution from an applicator mounted generally above the substrate, said substrate being mounted to rotate under said applicator about a first axis, said wiper assembly, as described in claim 1, wherein said wiper arm is constructed having a rigid portion and a flexible portion, said flexible portion connected to the rigid portion for engagement with the substrate.

6. A wiper assembly for use in the application of a polymeric coating to the ends of a substrate, in which the substrate is positioned to receive a stream of coating solution from an applicator mounted generally above the substrate, said substrate being mounted to rotate under said applicator about a first axis, said wiper assembly, as described in claim 1, further comprising a flexible wiper blade mounted on said transfer block for movement therewith, said blade extending towards the substrate to engage the substrate and wherein said applicator applies coating solution to the substrate in alignment with said blade, to allow said blade to wipe said solution over said substrate as the substrate rotates and said applicator and transfer block are moved parallel to said first axis.

* * * * *